United States Patent [19]

Skahill

[11] 4,261,246

[45] Apr. 14, 1981

[54] PRESSURE RELIEF VALVE FOR PROVIDING RECOIL TO BLANK-FIRING WEAPONS

[75] Inventor: Fred J. Skahill, Davenport, Iowa

[73] Assignee: The United States of America as represented by the Secretary of the Army, Washington, D.C.

[21] Appl. No.: 43,768

[22] Filed: May 30, 1979

[51] Int. Cl.[3] ..... F41F 17/12

[52] U.S. Cl. ..... 89/14 E

[58] Field of Search ..... 89/14 E

[56] References Cited

U.S. PATENT DOCUMENTS 4,128,040 12/1978 Schvetz ..... 89/14 E

*Primary Examiner*—Stephen C. Bentley

*Attorney, Agent, or Firm*—Nathan Edelberg; Robert P. Gibson; A. Victor Erkkila

[57] ABSTRACT

An improved pressure relief valve is provided for giving recoil to blank-firing weapons of the recoil type. This pressure relief valve includes a cap which is fitted to the muzzle of a gun allowing longitudinal movement of the barrel. The cap is provided with an endwall in which a series of circularly arranged holes are provided and it is maintained in a fixed position with respect to the loading end of the weapon by spaced rods which are secured to the cap's flange and anchored at their opposite ends to a barrel jacket of the weapon.

Positioned in the muzzle end of the bore of the weapon, and affixed to the endwall of the cap, is the pressure relief valve which is provided with diametrically opposite flats and a fully cylindrical portion sized to allow sliding movement in the bore of the barrel.

In operation, when the blank cartridge ignites, the gas expands down the bore of the barrel and is trapped inside the barrel by the valve, forcing the barrel into recoil. As the barrel recoils, the flats on the pressure relief valve are exposed and there is a rapid release of the gas pressure into the fixed end cap, where the unrestricted gas is vented through the holes in the endwall of the cap member. The pressure relief valve can be utilized with any recoil operated blank firing weapon.

11 Claims, 4 Drawing Figures

PRESSURE RELIEF VALVE FOR PROVIDING RECOIL TO BLANK-FIRING WEAPONS

GOVERNMENTAL INTEREST

The invention described herein may be manufactured, used and licensed by or for the Government for Governmental purposes without payment to me of any royalty thereon.

BACKGROUND AND SUMMARY OF THE INVENTION

This invention relates to ordnance weapons, and more particularly to an improved pressure relief valve for attachment to the muzzle end of barrels of blank firing weapons to provide recoil thereto.

Blank ammunition is used extensively in troop training maneuvers and military ceremonies.

Conventionally, the barrel for firing blanks was often equipped at its muzzle end with a blank firing attachment which is attached to a rigid barrel jacket. The blank firing attachment consisted of a containing member having a small aperture facing the open end of the muzzle. Because the aperture easily became fouled or clogged, and because the containing member tended to trap unburnt propellant residues, this blank firing attachment proved generally unsatisfactory.

In U.S. Pat. No. 3,941,029 issued to me on Mar. 2, 1976, for "Pressure Relief Valve for Providing Recoil to Blank-Firing Weapons", there is described a pressure relief valve which is screwed into the muzzle end of the barrel of a recoil operated weapon firing blank cartridges and into which the propellant gases provide barrel recoil and which at the same time will prevent or minimize residue buildup in the gun barrel. Such pressure relief valve although effective, is expensive to manufacture and to install in a recoil operated weapon, and its versatility is limited to a unique type of recoil operated weapon system.

It is thus a principal object of this invention to provide an improved pressure relief valve system for any recoil operated blank firing weapon which is economical to manufacture, easy to install on the weapon, and which is effective in minimizing or prevent corrosive residue buildup in the weapon.

It is another object of this invention to provide an improved pressure relief valve system which can be used to improve performance on any recoil operated blank firing weapon by allowing for precise control of pressure-time characteristics of blank ammunition.

Another object of this invention is to provide a recoil operated weapon barrel with an improved pressure relief valve system which can be utilized to recoil the barrel when blank cartridges are fired and to relieve the gas pressure therein and in which the weapon is not readily fouled, clogged, or corroded upon repeated firings of blank ammunition therein.

Still another object of this invention is to provide an improved pressure relief valve which provides both recoil to a recoil operated blank firing weapon and rapid venting of the propellant gases therein.

Another object of this invention is to provide an improved pressure relief valve which is easily attached to a gun barrel to fire blank ammunition, and which can be removed from the weapon for firing live ammunition as well as blank ammunition.

Further objects and attendant advantages of the invention will become more apparent in light of the following description of the preferred embodiment.

DESCRIPTION OF THE PREFERRED EMBODIMENT

Figure 1:
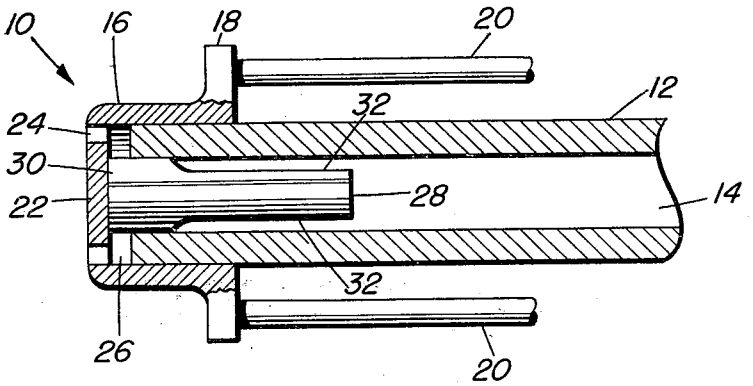
FIG. 1 is an axial section of the present invention applied to the muzzle end of a gun barrel showing a pressure relief valve in a closed position.
Figure 2:
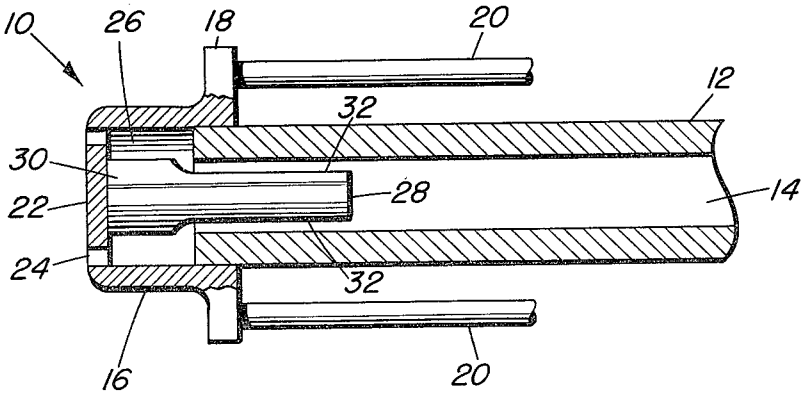
FIG. 2 is an axial section similar to FIG. 1, showing the gun barrel in a recoil position with the pressure valve in an open position.
Figure 3:
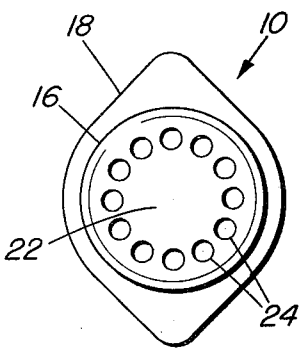
FIG. 3 is an end elevation viewed from the left of FIG. 1.

Referring now to the drawings, particularly to FIGS. 1, 2, 3, a pressure valve arrangement 10 which includes a cap 16 is fitted to allow sliding movement of the muzzle end of a gun barrel 12 within a longitudinal extending chamber 26 provided in the cap 16.

Figure 4:
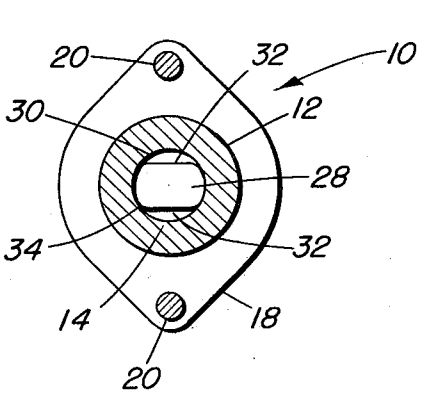
FIG. 4 is a cross-section viewed from the right of FIG. 1.

The cap 16 is fashioned with an endwall 22 in which a series of circularly arranged holes 24 are provided around the periphery thereof and an outwardly extending flange 18 at the opposite end thereof. This cap 16 is maintained in a fixed position with respect to the loading end of a gun barrel 12 by rods 20 which are secured to the flange 18 of the cap 16, and are anchored at their opposite ends to a barrel jacket, not shown, as best illustrated in FIGS. 1, 2, and 4.

The gun barrel 12 is provided with a bore 14. A pressure relief valve 28 is provided in the muzzle end of the bore 14 of the barrel 12, and it is affixed to the endwall 22 of the cap 16. This pressure relief valve is provided with diametrically opposite flats 32 as shown in FIGS. 1, 2, and 4, and a fully cylindrical portion 30 sized to allow sliding movement in the bore 14 of the barrel 12. As best seen in FIG. 4, the corners of flats 32 of the valve 28 are rounded off at 34.

This pressure relief valve 28 can be forms of Stellite 25 or L605 or other high temperature cobalt-base alloy steel, although other metallurgical structures can be used having similar metallurgical characteristics.

In actual operation, gases from an ignited blank cartridge in the gun expand along the bore 14 of the barrel 12 against the fixed pressure relief valve 28 and the endcap 16 forcing the barrel 12 into recoil, from the position shown in FIG. 1, to the position shown in FIG. 2, thus allowing gases to bleed past the now exposed flats 32 of the pressure relief valve 28 into the chamber 26 of the cap 16 and then exit through the holes 24 provided in the endwall 22.

Present 50 caliber blank ammunition was last produced during World War II. Most of the ammunition was not properly packaged and stored, resulting in ammunition that has erratic performance and some with no performance at all.

Generally, such ammunition will not meet new manufacturing standards. This is the cause for erratic performance of present 0.50 caliber BFAS. The greatest defect of the present 0.50 caliber BFAS is that they cause unusually high stresses on the weapons and thereby shorter life.

It is to be observed that there is a large variation in the pressures produced by different production lots of blank cartridges of the same caliber due to their varying propellant energies. In previous blank firing attachments it was necessary to continually adjust the diameter of the exhaust port to accommodate these production lot variations.

However, when employing the improved pressure relief valve 28 of this invention, no such adjustments are necessary since regardless of the magnitude of the pressure created by the particular blank cartridge, the recoil will take place only upon the attainment of a certain threshold pressure whether that pressure is obtained by a blank cartridge of high or low energy. When employing cartridges of comparatively high propellant energies, the recoil will quite obviously take place sooner than when employing blank cartridges of lower propellant energies.

It is apparent from the foregoing description that this improved pressure relief valve 28 provides both recoil to the blank firing barrel and most advantageous venting of propellant gases therein. The blank firing barrel 12 may readily be provided with a modified cartridge chamber which tapers forwardly to thus prevent inadvertent firing of live ammunition therein.

Accordingly, modifications and variations to which the invention is susceptible may be practiced without departing from the scope of the appended claims.

I claim:

1. In a recoil operated weapon having a barrel with a bore used for firing blank cartridges, a cap member having a longitudinally extending cylindrical chamber provided on the inside thereof to allow sliding movement of the muzzle and of said barrel therein, an endwall for enclosing one end of said cap member, said endwall having at least one vent hole provided therethrough, the opposite end of said cap member being opened and being provided with an outwardly extending peripheral flange, means connected to said flange of said cap member and the jacket of said barrel for maintaining said cap member in a fixed position with respect to the loading end of said weapon, with the muzzle end of said barrel being slidably and flushably positioned in the cylindrical chamber of said cap member, in combination valve means affixed at one end to the endwall of said cap, said valve means being formed of a cylindrical portion to allow sliding movement in the bore at the muzzle end of said barrel and having diametrically opposite flats at the opposite end thereof arranged to communicate with said cylindrical chamber when said gun barrel is in a recoiled position.

2. In the combination of the structure of claim 1, wherein said endwall is provided with a series of spaced vent holes.

3. In the combination of the structure of claim 1, wherein said pressure relief valve means is formed of Stellite.

4. In the combination of the structure of claim 1, wherein said endwall of said cap member is formed with a series of spaced circularly arranged circular holes for venting the gases from the chamber of said cap member.

5. In the combination of the structure of claim 1, wherein said cap member is of cylindrical shape, and said flange extends transversely therefrom.

6. In the combination of the structure of claim 5, wherein said means connected to said flange of said cap member and the jacket of said barrel is a plurality of evenly spaced rods.

7. In combination with a recoil operated weapon having a barrel with a bore used for firing blank cartridges, the improvement therewith comprising a pressure relief valve arrangement consisting of a cap member having a longitudinally extending cylindrical chamber provided on the inside thereof to allow sliding movement of the muzzle end of said barrel therein, an endwall for enclosing one end of said cap member, said endwall having a series of spaced vent holes provided therethrough, the opposite end of said cap member being opened and being provided with an outwardly extending peripheral flange, the muzzle end of said barrel being slidably and flushably positioned in the cylindrical chamber of said cap member, valve means affixed at one end to the endwall of said cap, said valve means being formed of a cylindrical portion to allow sliding movement in the bore at the muzzle end of said barrel and having diametrically opposite flats at the opposite end thereof arranged to communicate with said cylindrical chamber when said gun barrel is in a recoiled position, means connected to said flange of said cap member and the jacket of said barrel for maintaining said cap member in a fixed position with respect to the loading end of said weapon, whereby when a blank cartridge is ignited in the chamber of said weapon, the gases therefrom expand along the bore of said barrel against said fixed valve means and cap member forcing said barrel into recoil, thus allowing the gases to bleed past the exposed flats of said valve means into the cylindrical chamber of said cap member and vented through said holes in said endwall of said cap member.

8. In the combination of the structure of claim 7, wherein said pressure relief valve means is formed of Stellite.

9. In the combination of the structure of claim 7, wherein said endwall of said cap member is formed with a series of spaced circularly arranged circular holes for venting the gases from the chamber of said cap member.

10. In the combination of the structure of claim 7, wherein said cap member is of cylindrical shape, and said flange extends transversely therefrom.

11. In the combination of the structure of claim 10, wherein said means connected to said flange of said cap member and the jacket of said barrel is a plurality of evenly spaced rods.

* * * * *